US010772403B1

(12) United States Patent
Shiao

(10) Patent No.: US 10,772,403 B1
(45) Date of Patent: Sep. 15, 2020

(54) ASSEMBELED MULTIFUNCTIONAL CYLINDRICAL BAG

(71) Applicant: Kun-Lin Shiao, Taoyuan (TW)

(72) Inventor: Kun-Lin Shiao, Taoyuan (TW)

(73) Assignee: Kun-Lin Shiao, Taoyuan (TW)

( * ) Notice: Subject to any disclaimer, the term of this patent is extended or adjusted under 35 U.S.C. 154(b) by 0 days.

(21) Appl. No.: 16/534,774

(22) Filed: Aug. 7, 2019

(51) Int. Cl.

| | |
|---|---|
| ***A45C 9/00*** | (2006.01) |
| ***A45C 11/20*** | (2006.01) |
| ***A45C 13/10*** | (2006.01) |
| *A63B 55/20* | (2015.01) |

(52) U.S. Cl.
CPC ..... *A45C 9/00* (2013.01); *A45C 11/20* (2013.01); *A45C 13/103* (2013.01); *A45C 2009/002* (2013.01); *A63B 55/20* (2015.10)

(58) Field of Classification Search
CPC ..... A45C 9/00; A45C 2009/002; A45C 11/20; A45C 13/103
USPC ..... 206/315, 315.2, 315.3; 248/95, 96
See application file for complete search history.

(56) References Cited

U.S. PATENT DOCUMENTS

| | | | | |
|---|---|---|---|---|
| D366,812 | S * | 2/1996 | Collins | D3/255 |
| 6,092,661 | A * | 7/2000 | Mogil | A63B 55/408 150/106 |
| 7,780,051 | B2 * | 8/2010 | Godshaw | A45C 3/00 206/372 |
| 2005/0103044 | A1 * | 5/2005 | Mogil | A45C 11/20 62/457.7 |
| 2012/0168447 | A1 * | 7/2012 | Mogil | A45C 5/02 220/592.2 |

* cited by examiner

*Primary Examiner* — Steven A. Reynolds
*Assistant Examiner* — Javier A Pagan
(74) *Attorney, Agent, or Firm* — Marshall A. Lerner; Bradford E. Mattes; Kleinberg & Lerner, LLP

(57) ABSTRACT

An assembled multifunctional cylindrical bag has an outer bag assembly and an inner cylinder assembly detachably mounted in the outer bag assembly. The inner cylinder assembly is made of a rigid material to support the outer bag assembly so that the outer bag assembly can stand while remaining its shape to provide seating. The inner cylinder assembly has an inner cylinder with a thermal insulation function for storage of foods or drinks. The outer bag assembly can be implemented in any forms such us balls or sports-related equipment for commercial purposes. When the inner cylinder assembly is detached from the outer bag assembly, the outer bag assembly is adapted to store any items including sports accessories. Therefore, the assembled multifunctional cylindrical bag offers different functions for the user to choose from to fit for various occasions.

14 Claims, 5 Drawing Sheets

ASSEMBELED MULTIFUNCTIONAL CYLINDRICAL BAG

BACKGROUND OF THE INVENTION

1. Field of the Invention

The present invention relates to a cylindrical bag-style container, especially to a cylindrical bag that offers multiple functions via combinations of bag-and-cylinder assemblies.

2. Description of the Prior Arts

Containers are normally used to meet needs of storage. Herein a container generally refers to any tool that is used to accommodate, store, or transport objects. For applications in diversified fields and functions, containers of various characteristics are provided, ranging from small ones, such as bottles, cans, and jars, to large ones such as boxes, baskets, bags, golf balls or socks etc.

Enhanced by commercial promotion, classifications of containers go into more diversified and dedicated categories. With reference to FIG. 5, a lightweight golf Den Caddy bag is shown. Different from a conventional golf den caddy bag, the lightweight golf den caddy bag is simplified in design. The lightweight golf den caddy bag has a base 91 and a cylinder wall 92. The cylinder wall 92 surrounds a periphery of the base 91 and extends upright to form a storage space. A top of the cylinder wall 92 forms an opening 93. A user is able to store and carry golf-related items, such as clubs, balls, sports accessories, and other items such as umbrella, for example.

However, despite the term "lightweight", the abovementioned lightweight golf bag only provides a basic storage function with little versatility and low additional value. Therefore, how to offer a bag offering multiple functions to the user via clever structural design without affecting its basic functionality is an issue to be resolved.

To overcome the shortcomings, the present invention provides an assembled multifunctional cylindrical bag to mitigate or obviate the aforementioned problems.

SUMMARY OF THE INVENTION

The main objective of the present invention is to provide an assembled multifunctional cylindrical bag with an inner cylinder being detachable and having a thermal insulation function, thereby offering diversified additional functions beyond the basic storage, which facilitates versatility in use.

The assembled multifunctional cylindrical bag has an outer bag assembly and an inner cylinder assembly. The outer bag assembly has an outer bag, an outer bag annular wall, an outer bag opening, and an outer cap. The outer bag has an outer bag space. The outer bag annular wall surrounds the outer bag space. The outer bag opening is formed on an end of the outer bag annular wall and communicates with the outer bag space. The outer cap selectively closes the outer bag opening. The inner cylinder assembly is detachably mounted in the outer bag space of the outer bag and has an inner cylinder, an inner cylinder annular wall, and an inner cylinder opening. The inner cylinder has an inner cylinder space with a thermal insulation function. The inner cylinder annular wall is made of a rigid material and surrounds the inner cylinder space. The inner cylinder opening is formed on an end of the inner cylinder annular wall and communicates with the inner cylinder space.

According to the abovementioned structure, the present invention has an outer bag assembly and an inner cylinder assembly which is detachably mounted inside the outer bag assembly. The inner cylinder assembly supports the outer bag assembly by the rigid inner cylinder annular wall, so the outer bag assembly has sufficient structural strength for the user to sit thereon and still maintains its shape. The inner cylinder of the inner cylinder assembly stores items in the inner cylinder space and has a thermal insulation function to keep the stored items cold or warm, such as storing drinks in the summer and keeping cooked food warm. Moreover, since the inner cylinder assembly is detachably assembled inside the outer bag assembly, the outer bag space of the outer bag assembly offers a bigger containing space when the inner cylinder assembly is removed from the outer bag assembly, thereby providing a larger storage capacity and better portability.

The versatility of the aforementioned assembled multifunctional cylindrical bag is even more manifested when applied in specific fields such as golfing or indoor or out door parties. For example, when the assembled multifunctional cylindrical bag is used as a lightweight golf den caddy bag, the outer bag assembly can be simply used as a ball bag, or the outer bag assembly can be assembled with the inner cylinder assembly for users to sit thereon and offer cold drinks for cooling off in hot weather.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
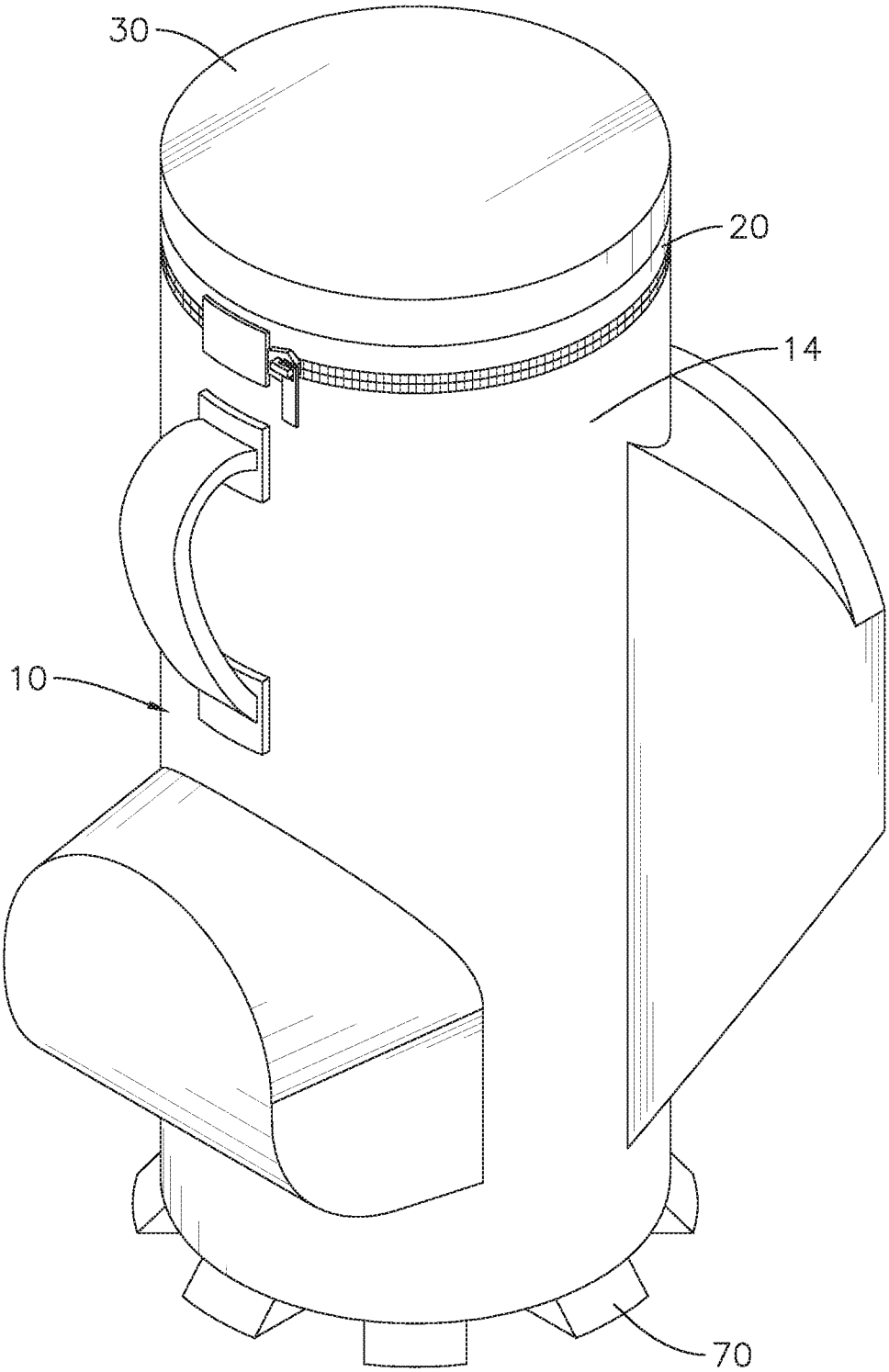
FIG. 1 is a perspective view of an assembled multifunctional cylindrical bag in accordance with the present invention.
Figure 2:
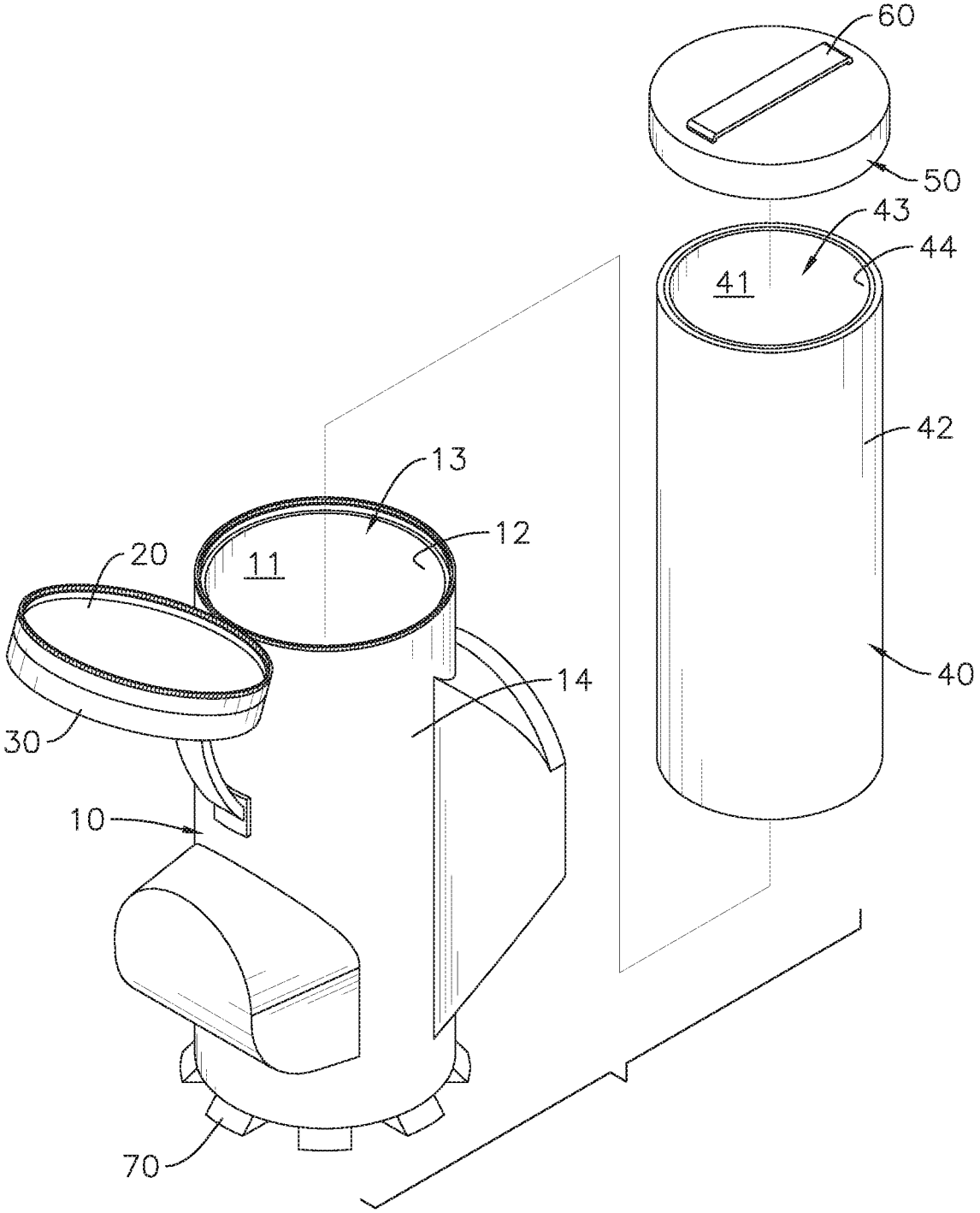
FIG. 2 is an exploded view of the assembled multifunctional cylindrical bag in FIG. 1.

With reference to FIGS. 1 and 2, a preferred embodiment of an assembled multifunctional cylindrical bag in accordance with the present invention comprises an outer bag assembly and an inner cylinder assembly detachably mounted in the outer bag assembly.

The outer bag assembly has an outer bag 10, an outer bag annular wall 12, an outer bag opening 13, and an outer cap 20. The outer bag 10 has an outer bag space 11.

Figure 3:
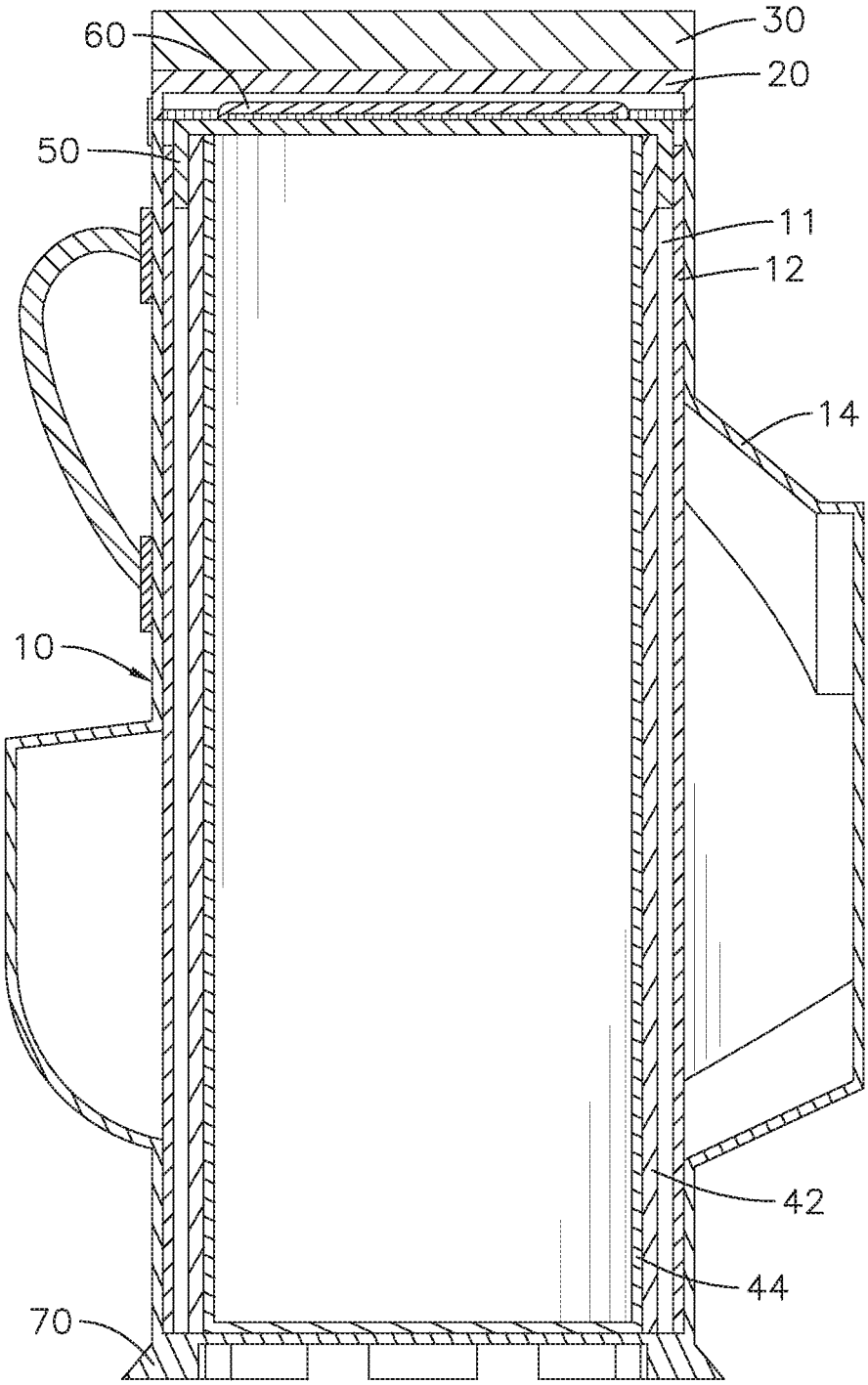
FIG. 3 is a side view in cross-section of the assembled multifunctional cylindrical bag in FIG. 1.

With further reference to FIGS. 2 and 3, the outer bag annular wall 12 surrounds the outer bag space 11. The outer bag annular wall 12 can be made of a soft or rigid material, and in this preferred embodiment, the outer bag annular wall 12 is rigid, and is made from a polyethylene board.

The outer bag opening 13 is formed on an end of the outer bag annular wall 12 and communicates with the outer bag space 11. In this preferred embodiment, the outer bag opening 13 is located on a top end of the outer bag 10.

In another preferred embodiment, the outer bag assembly further has a wrapping layer 14. The wrapping layer 14 covers an outer surface of the outer bag annular wall 12 and is made from cloth or leather. Specifically, the wrapping layer 14 is the outermost layer of the present invention on which the manufacturer can change or decorate the appearance for advertising without affecting the main function of the present invention. For example, the wrapping layer 14 can be made to resemble appearance of a beverage bottle, or can be designed with a special color combination or printed with trademarks, etc.

The outer cap 20 selectively closes the outer bag opening 13 and has an outer cap exterior surface. When the outer cap 20 closes the outer bag opening 13, the outer cap exterior surface faces away from the outer bag opening 13. Specifically, in this preferred embodiment, the outer cap 20 is mounted on a periphery of the outer bag opening 13 by a zipper and thereby selectively seals the outer bag opening. But it is not limited to the abovementioned, as the outer cap 20 can be mounted on the periphery of the outer bag opening 13 by with a hook and loop fastener or a magnet, or the outer cap 20 can be detachably mounted and capped on the periphery of the outer bag opening 13, as long as the outer cap 20 is able to open and close the outer bag opening 13.

In this preferred embodiment, the outer cap 20 further has a soft pad 30 mounted on the outer cap exterior surface. Therefore, when the outer cap 20 is capped on the outer bag 10, the soft pad 30 is located outside. By this, when the present invention is placed on the ground with the outer cap 20 closed, the user can sit on the outer cap 20 comfortably with the soft pad 30.

In still another preferred embodiment, the outer bag 10 further has multiple supporting components 70 mounted on an end that is opposite to the outer bag opening 13 of the outer bag 10. The supporting components 70 are annularly spaced apart from each other at equal intervals. The supporting components 70 extend beyond the outer bag annular wall 12 along a radial direction of the outer bag annular wall 12. By this, the outer bag 10 can be placed on the ground via the supporting components 70. Because the supporting components 70 protrude outward along the radial direction, the outer bag 10 stands more stably and is supported by the supporting components 70 without prone to falling.

The inner cylinder assembly is detachably mounted in the outer bag space 11. The inner cylinder assembly has an inner cylinder 40, an inner cylinder annular wall 42, and an inner cylinder opening 43, wherein the inner cylinder 40 has an inner cylinder space 41 with a thermal insulation function.

The inner cylinder annular wall 42 is rigid and surrounds the inner cylinder space 41. In this preferred embodiment, the inner cylinder annular wall 42 is made from a polyethylene board.

The inner cylinder opening 43 is formed on an end of the inner cylinder annular wall 42 and is communicating with the inner cylinder space 41. When the inner cylinder assembly is assembled inside the outer bag space 11, the inner cylinder opening 43 of the inner cylinder 40 faces to the outer bag opening 13.

In this preferred embodiment, the inner cylinder assembly further has an ice pack 44. The ice pack 44 is mounted in the inner cylinder space 41 and has an ice pack opening. A periphery of the ice pack opening is mounted on a periphery of the inner cylinder opening 43. By this, the inner cylinder space 41 of the inner cylinder 40 can be used as a refrigerator, and thus the inner cylinder 40 is adapted to load ice and refrigerate drinks during hot weather.

In this preferred embodiment, the inner cylinder assembly further has an inner cap 50. The inner cap 50 selectively closes the inner cylinder opening 43 of the inner cylinder 40. The inner cap 50 has an inner cap exterior surface. When the inner cap 50 closes the inner cylinder opening 43 of the inner cylinder 40, the inner cap exterior surface faces away from the inner cylinder opening 43. Besides, in this preferred embodiment, the inner cap 50 is detachably mounted and capped on the periphery of the inner cylinder opening 43, thereby selectively closing the inner cylinder opening 43.

The inner cap 50 further has a handle 60 mounted on the inner cap exterior surface. The inner cylinder 40 is assembled in the outer bag space 11 when in use, and the inner cap 50 is capped on the periphery of the inner cylinder opening 43, i.e. the inner cap 50 is also located in the outer bag space 11 when in use. Therefore, mounting the handle 60 on the inner cap exterior surface allows the user to directly access the inner cap 50 to open the inner cylinder opening 43 without being limited by the outer bag annular wall 12. That is, the user does not have to take out the inner cylinder 40 from the outer bag space 11 before opening the inner cylinder opening 43.

Figure 4:
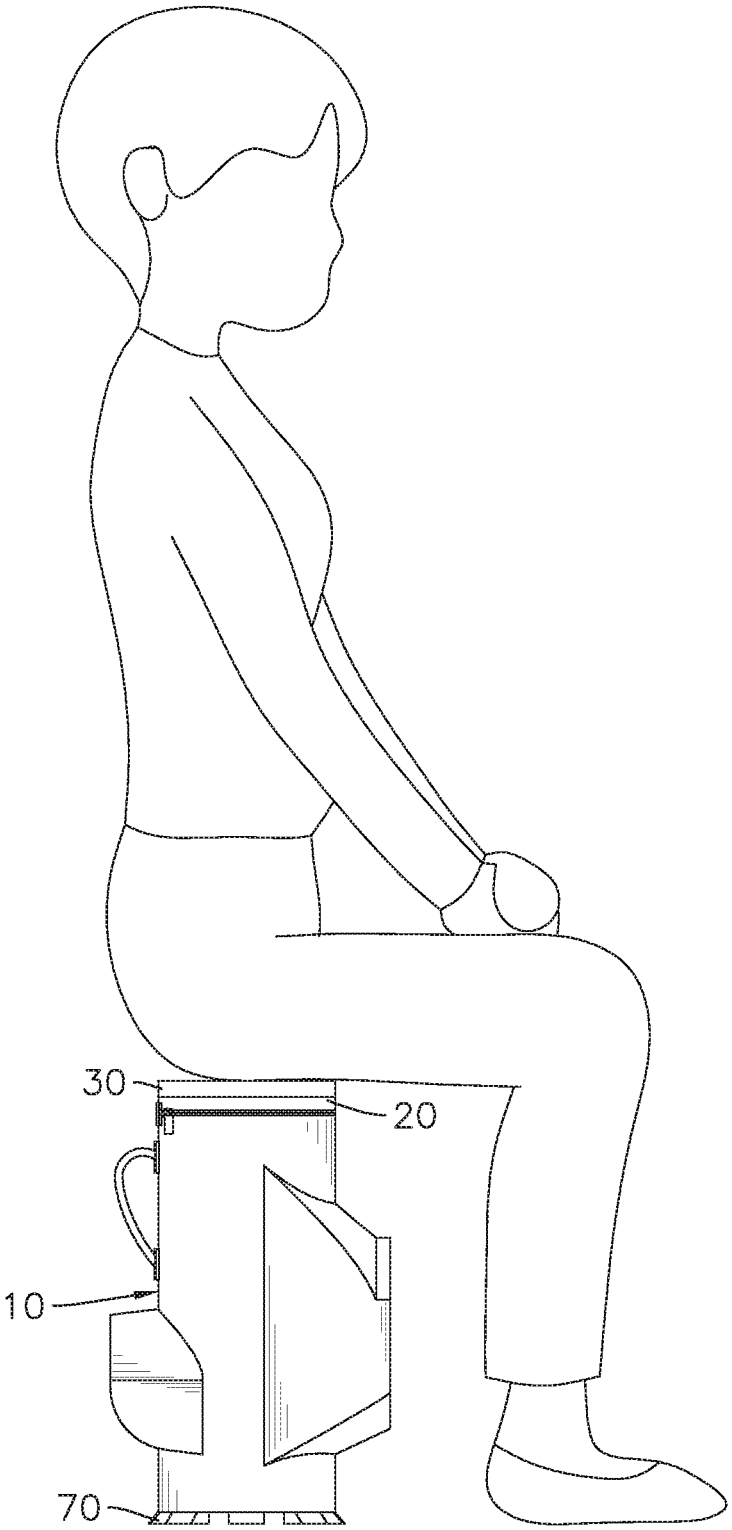
FIG. 4 is a side view of the assembled multifunctional cylindrical bag in FIG. 1; showing the cylindrical bag in use.
Figure 5:
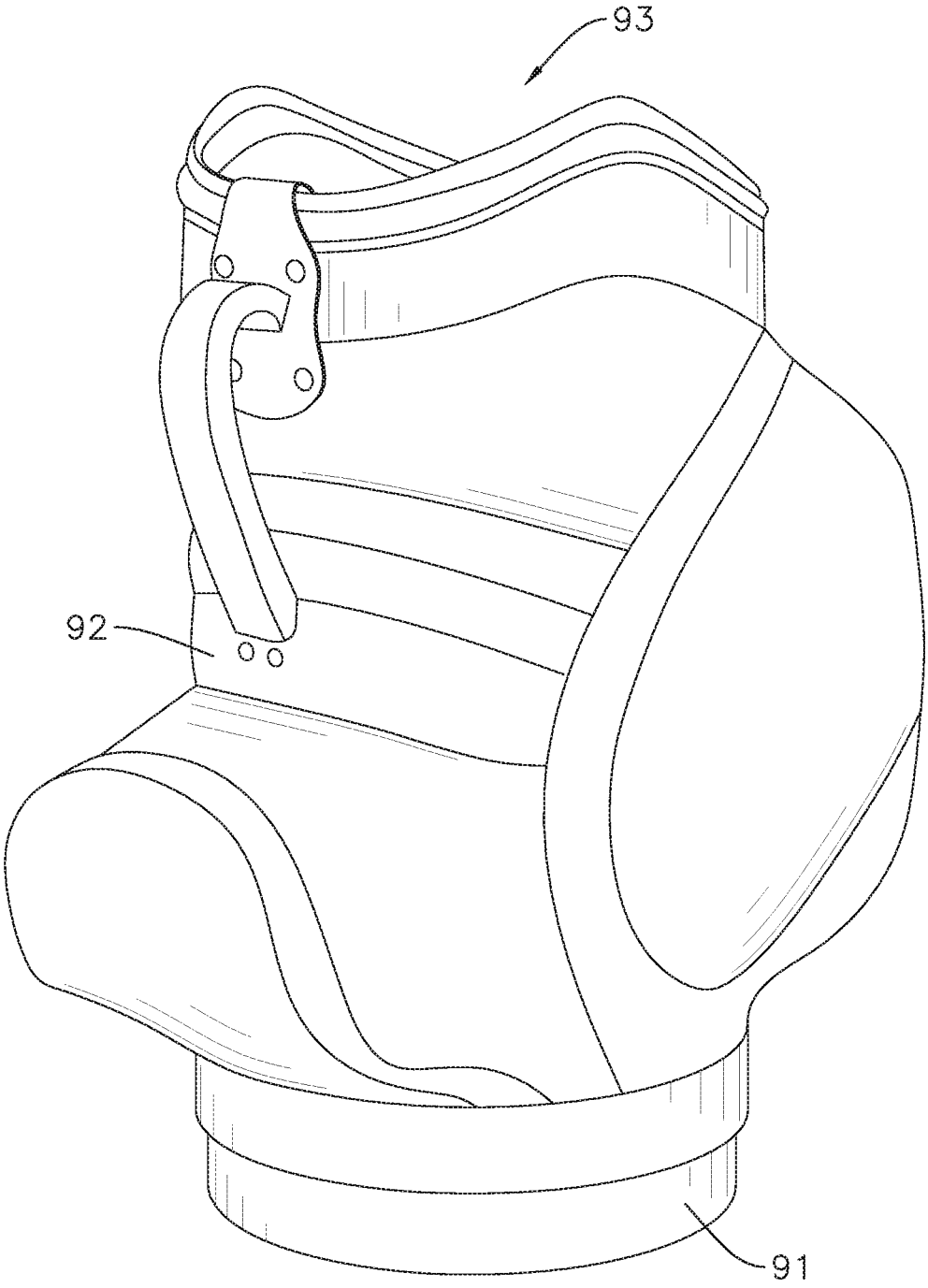
FIG. 5 is a perspective view of a conventional lightweight golf den caddy bag.

With further reference to FIGS. 2, 3 and 4, by mounting the inner cylinder 40 in the outer bag space 11, adopting the rigid inner cylinder annular wall 42 as a support structure, and mounting the soft pad 30 on the outer cap 20, the user can close the outer cap 20 and then the present invention is adapted for seating. Therefore, the present invention is not only adapted to load items but also can be used as a chair. Additionally, the inner cylinder 40 can be used as an insulated ice bucket to load ice and drinks during hot weather, further enhancing functionality and convenience. Besides, by changing the appearance of the wrapping layer 14, for example making the wrapping layer 14 resemble a beverage bottle, designed with a special color combination, or printed with a trademark, etc., advertising and publicity purposes are both achieved without affecting the main functionality of the present invention.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An assembled multifunctional cylindrical bag comprising:

an outer bag assembly having an outer bag having an outer bag space;

an outer bag annular wall surrounding the outer bag space;

an outer bag opening formed on an end of the outer bag annular wall and communicating with the outer bag space; and an outer cap selectively closing the outer bag opening;

multiple supporting components mounted on an end, which is opposite to the outer bag opening, of the outer bag; the supporting components annularly spaced apart from each other at equal intervals; the supporting components extending beyond the outer bag annular wall along a radial direction of the outer bag annular wall; and an inner cylinder assembly detachably mounted in the outer bag space of the outer bag and having an inner cylinder having an inner cylinder space having a thermal insulation function;

an inner cylinder annular wall being rigid and surrounding the inner cylinder space; the rigid inner cylinder annular wall supporting the outer bag assembly so that the outer bag assembly is adaptable for a user to sit thereon;

an inner cylinder opening formed on an end of the inner cylinder annular wall and communicating with the inner cylinder space; and an inner cap selectively closing the inner cylinder opening of the inner cylinder.

2. The assembled multifunctional cylindrical bag as claimed in claim 1, wherein the outer cap has an outer cap exterior surface; when the outer cap closes the outer bag opening, the outer cap exterior surface faces away from the outer bag opening;

the assembled multifunctional cylindrical bag further has a soft pad mounted on the outer cap exterior surface of the outer cap.

3. The assembled multifunctional cylindrical bag as claimed in claim 2, wherein the inner cylinder further has an ice pack mounted in the inner cylinder space and having an ice pack opening; a periphery of the ice pack opening mounted on a periphery of the inner cylinder opening.

4. The assembled multifunctional cylindrical bag as claimed in claim d wherein the inner cap has an inner cap exterior surface; wherein when the inner cap closes the inner cylinder opening of the inner cylinder, the inner cap exterior surface faces away from the inner cylinder opening;

a handle mounted on the inner cap exterior surface.

5. The assembled multifunctional cylindrical bag as claimed in claim 4, wherein the outer bag further has a wrapping layer made from cloth or leather and covering an outer surface of the outer bag annular wall.

6. The assembled multifunctional cylindrical bag as claimed in claim 5, wherein the outer cap is connected to a periphery of the outer bag opening by a zipper, the outer cap selectively seals the outer bag opening via the zipper.

7. The assembled multifunctional cylindrical bag as claimed in claim 6, wherein the outer bag annular wall is made of a rigid material.

8. The assembled multifunctional cylindrical bag as claimed in claim 7, wherein the outer bag annular wall is made from a polyethylene board; and the inner cylinder annular wall is made from a polyethylene board.

9. The assembled multifunctional cylindrical bag as claimed in claim 1, wherein the inner cylinder further has an ice pack mounted in the inner cylinder space and having an ice pack opening; a periphery of the ice pack opening mounted on a periphery of the inner cylinder opening.

10. The assembled multifunctional cylindrical bag as claimed in claim 1, wherein the inner cap has an inner cap exterior surface; wherein when the inner cap closes the inner cylinder opening of the inner cylinder, the inner cap exterior surface faces away from the inner cylinder opening;

a handle mounted on the inner cap exterior surface.

11. The assembled multifunctional cylindrical bag as claimed in claim 1, wherein the outer bag further has a wrapping layer made from cloth or leather and covering an outer surface of the outer bag annular wall.

12. The assembled multifunctional cylindrical bag as claimed in claim 1, wherein the outer cap is connected to a periphery of the outer bag opening by a zipper, the outer cap selectively seals the outer bag opening via the zipper.

13. The assembled multifunctional cylindrical bag as claimed in claim 1, wherein the outer bag annular wall is made of a rigid material.

14. The assembled multifunctional cylindrical bag as claimed in claim 13, wherein the outer bag annular wall is made from a polyethylene board; and the inner cylinder annular wall is made from a polyethylene board.

* * * * *